US008521044B2

(12) United States Patent
Suzuki

(10) Patent No.: US 8,521,044 B2
(45) Date of Patent: Aug. 27, 2013

(54) IMAGE FORMING APPARATUS

(75) Inventor: Shinichi Suzuki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 13/108,408

(22) Filed: May 16, 2011

(65) Prior Publication Data

US 2011/0280600 A1 Nov. 17, 2011

(30) Foreign Application Priority Data

May 17, 2010 (JP) ..... 2010-113292

(51) Int. Cl.
*G03G 15/00* (2006.01)

(52) U.S. Cl.
USPC ..... 399/44; 399/66

(58) Field of Classification Search
USPC ..... 399/44, 66
See application file for complete search history.

(56) References Cited

U.S. PATENT DOCUMENTS 5,819,131 A * 10/1998 Kim ..... 399/44
8,045,867 B2 * 10/2011 Park ..... 399/44

FOREIGN PATENT DOCUMENTS

JP 05-127544 A 5/1993

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member; a developing device for developing an electrostatic latent image formed on the image bearing member; a transferring device for transferring the toner image formed on the image bearing member onto a transfer material; a first ambience detecting device for detecting a humidity inside the image forming apparatus and outside the developing device; a second ambience detector for detecting a humidity inside the developing device; and a setting device for setting a transferring current on the basis of results of detection of the first an ambience detector and the second ambience detector.

4 Claims, 9 Drawing Sheets

(A)

(B)

IMAGE FORMING APPARATUS

FIELD OF THE INVENTION AND RELATED ART

The present invention relates to an image forming apparatus such as an electrophotographic copying machine or a laser beam printer, more particularly to an improvement in a transferring device for transferring an image from an image bearing member onto a transfer material.

As for the image transfer device for an image forming apparatus, there are known a direct transfer type in which a toner image formed on a photosensitive member (image bearing member) is transferred directly onto a recording material, and an intermediary transfer type in which the image is transferred through an intermediary transfer member onto the recording material. In either of the types, a surface of the photosensitive member is charged to a predetermined potential, and an electrostatic latent image is formed on the surface by an exposure device such as a laser device. The electrostatic latent image is developed by a developing device into a toner image, which is transferred directly onto the recording material (direct transfer type) or onto an intermediary transfer member (primary transfer, in the intermediary transfer type) and then onto the recording material (secondary transfer). The toner image having been transferred onto the recording material is fixed on the recording material by a fixing device.

A structure is known in which when the toner image is transferred onto a transfer material such as the recording material or a belt, an ambience of the image forming apparatus is detected, and a transfer condition is controlled on the basis of the detection (Japanese Laid-open Patent Application Hei 5-127544). With such a structure, even when the ambient condition in which the image forming apparatus is placed is different, the transfer property can be maintained properly because the charging state of the toner can be deduced on the basis of the detected ambient condition.

However, such a structure involves a problem.

When toner is replenished into the developing device, or when a cartridge including a developing device or a photosensitive drum is exchanged, the ambient condition of the image forming apparatus and the ambient condition of the toner in the developing device may be different from each other.

In such a case, if the transfer condition is selected on the basis of the ambient condition of the image forming apparatus, the transfer condition may not be proper due to the difference between the actual ambient condition and the ambient condition of the image forming apparatus. As a result, the transfer property deteriorates. Then, the load of the cleaning member increases, which is not preferred. Therefore, further improvement of the transfer property is desired.

SUMMARY OF THE INVENTION

Accordingly, it is an object of the present invention to provide an image forming apparatus in which the deterioration of the transfer property due to the change of an amount of electric charge of the toner in the developing device.

According to an aspect of the present invention, there is provided an image forming apparatus comprising an image bearing member; a developing device for developing an electrostatic latent image formed on said image bearing member; transferring means for transferring the toner image formed on said image bearing member onto a transfer material; first ambience detecting means for detecting a humidity inside said image forming apparatus and outside said developing device; second ambience detecting means for detecting a humidity inside said developing device; and setting means for setting a transferring current on the basis of results of detection of said first ambience detecting means said second ambience detecting means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Overall Structure of Image Forming Apparatus

Figure 1:
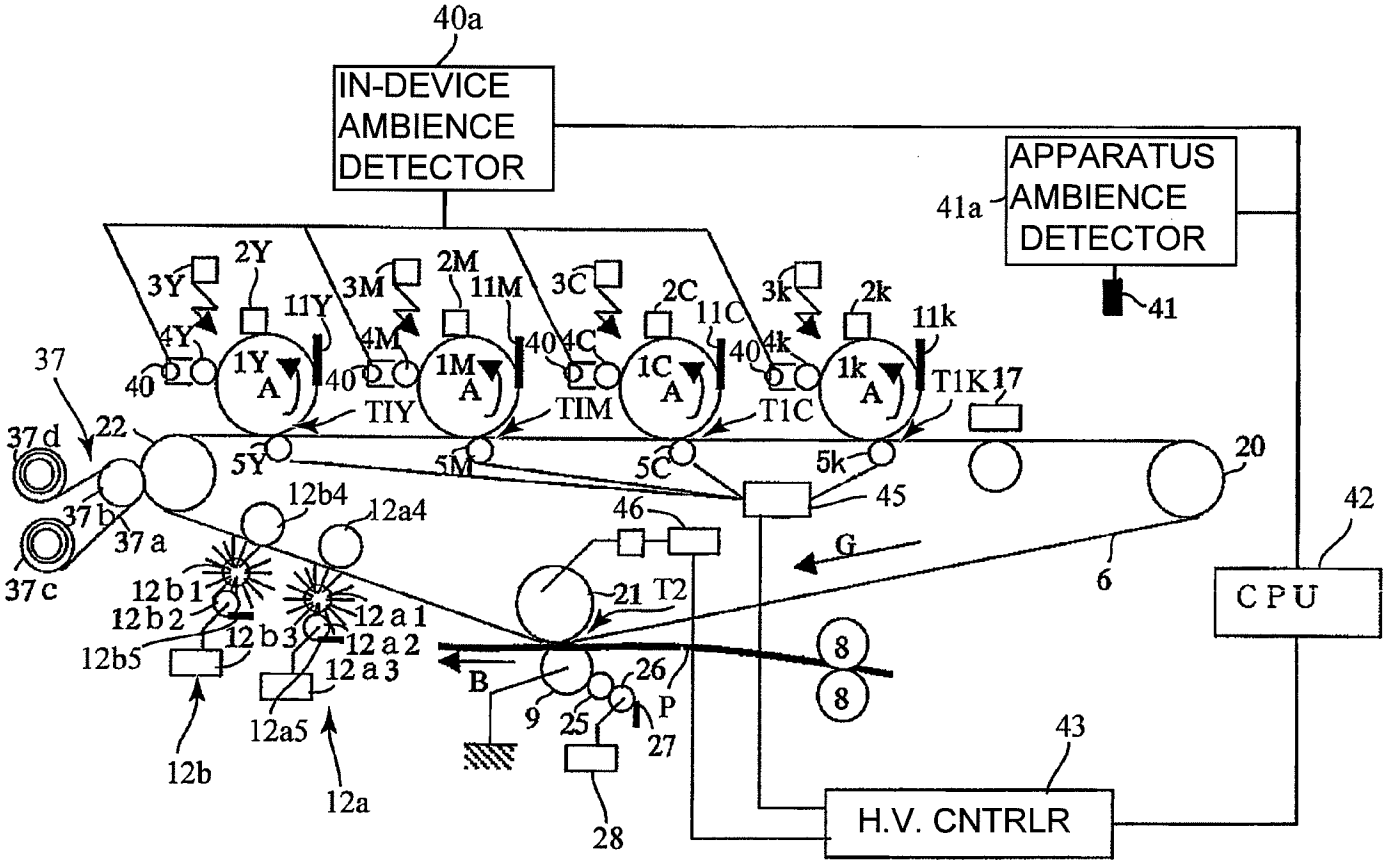
FIG. 1 is a schematic illustration of an image forming apparatus according to a first embodiment of the present invention.

First, referring to FIGS. 1-7, the first preferred embodiment of the present invention is described. Referring to FIG. 1, the general structure of the image forming apparatus in this embodiment is described. Incidentally, the image forming apparatus in this embodiment is of the so-called tandem type, which has yellow (Y), magenta (M), cyan (C), and black (Bk) image forming stations which form yellow, magenta, cyan, and black monochromatic images, respectively. Since the four image forming stations are basically the same in structure and function, the structure of the yellow image forming stations is described as the image forming station which represents the four stations. The components of the other image forming stations, which are the same in structure and function, as the counterparts of the yellow image forming station, are given the same numerical referential codes as those given to the counter parts of the yellow image forming station, and their difference from the yellow image forming station are indicated by giving each numerical referential code an alphabetical suffix which indicates the color of the monochromatic image it forms.

The image forming station Y has a cylindrical electrophotographic photosensitive member 1Y (which hereafter will be referred to simply as photosensitive drum 1), which is made up of a cylindrical substrate and a surface layer. The surface layer is formed of an OPC (organic photosensitive semiconductor), for example. The photosensitive drum 1Y is rotated in the direction indicated by an arrow mark A. Designated by a referential code 2Y is a charging device for uniformly charging the peripheral surface of the photosensitive drum 1Y. As a preset bias is applied to the charging device 2Y, the charging device 2Y uniformly charges the peripheral surface of the photosensitive drum 1Y to a preset potential level. The uniformly charged portion of the peripheral surface of the photosensitive drum 1Y is exposed by an exposing device 3Y; it is exposed to a beam of exposure light (laser light, etc.) projected by the exposing device 3Y while being modulated according to the information of the image to be formed, which is inputted from an unshown external device, such as an image scanner, a computer, or the like. Thus, an electrostatic image is formed on the uniformly charged portion of the peripheral surface of the photosensitive drum 1Y.

A developing device 4Y contains toner in its container, and develops the electrostatic latent image on the peripheral surface of the photosensitive drum 1Y with the use of its development roller and the charged toner in the container, into a visible image (which is formed of toner), which exactly reflects the electrostatic latent image; it forms a visible image (which is formed of toner) on the peripheral surface of the photosensitive drum 1Y. The toner image formed on the peripheral surface of the photosensitive drum 1Y is transferred onto an intermediary transfer belt 6, in a first transfer station T1Y. More concretely, the image forming apparatus has a first transfer roller 5Y (which is first transferring means) and the intermediary transfer belt 6 (which is intermediary transferring member). The area of contact between the first transfer roller 5Y and intermediary transfer belt 6 is the first transfer station T1Y. The intermediary transfer belt 6 is circularly moved by the first transfer roller 5Y at virtually the same velocity as the peripheral velocity of the photosensitive drum 1Y. As a high voltage, which is being controlled in magnitude by a CPU 42, is applied to the first transfer roller 5Y through a transfer voltage control circuit 43 (which will be described later), the toner image on the peripheral surface of the photosensitive drum 1Y is transferred (first transfer) onto the intermediary transfer belt 6. Incidentally, the photosensitive drums 1Y, 1M, 1C, and 1K are grounded.

The first transfer residual toner, that is, the toner remaining on the peripheral surface of the photosensitive drum 1Y after the first transfer, is recovered by a photosensitive drum cleaning device 11Y, which is a cleaning device for cleaning an image bearing member of the contact type. That is, it has a cleaning blade or the like, and removes the first transfer residual toner on the peripheral surface of the photosensitive drum 1Y by placing the blade or the like in contact with the peripheral surface of the photosensitive drum 1Y. After the removal of the first transfer residual toner from the peripheral surface of the photosensitive drum 1Y, the portion of the peripheral surface of the photosensitive drum 1Y, from which the first transfer residual toner has just been removed, is uniformly charged again by the charging device 2Y, and is used again for image formation. That is, the peripheral surface of the photosensitive drum 1Y is repeatedly used for image formation.

The intermediary transfer belt 6 is held and kept stretched by a driver roller 22, a tension roller 20, a belt backing roller 21 (second transfer roller). It is circularly moved by the rotation of the driver roller 22 in the direction indicated by an arrow mark G while remaining in contact with the four photosensitive drums 1Y, 1M, 1C, and 1K of the image forming stations Y, M, C, and K, respectively. The tension roller 20 is controlled by an unshown pressure applying means so that the tension of the intermediary transfer belt 6 remains at a preset level.

When the image forming apparatus is in the full-color mode, an image forming operation such as the one described above is carried out by each of the four image forming stations Y, M, C, and Bk. That is, monochromatic yellow, magenta, cyan, and black toner images are formed on the photosensitive drums 1Y, 1M, 1C, and 1Bk, respectively. Then, the four monochromatic toner images are sequentially transferred in layers onto the intermediary transfer belt 6. Incidentally, the order in which the four monochromatic toner images are formed is optional; it depends on the design of the image forming apparatus used for image formation.

After the multilayer transfer of the four monochromatic images, different in color, onto the intermediary transfer belt 6, the four toner images are transferred together (second transfer) onto a sheet P of recording medium, in the second transfer station T2, which is the interface between the backing roller 21 (which is second transferring means) and a second transfer roller 9. To the backing roller 21, a high voltage (second transfer bias) which is being kept stable in magnitude at a reset level by the CPU 42 is applied from an electric power source 46 through a transfer voltage control circuit 43 (which will be described later), whereby the layered four monochromatic toner images on the intermediary transfer belt 6 are transferred (second transfer) onto the sheet P of recording medium.

The sheets P of recording medium, which are in a sheet feeder cassette (unshown), are fed into the main assembly of the image forming apparatus, one by one, while being separated from the rest. Then, each sheet P of recording medium is conveyed further by a pair of registration rollers 8 with such a timing that each sheet P arrives at the second transfer station T2 at the same time as the multilayered four monochromatic toner images on the intermediary transfer belt 6 arrive at the second transfer station T2.

In this embodiment, the image forming station for forming an image on the sheet P of recording medium is structured as described above. After the formation of the multilayer toner images on the sheet P of recording medium by the image forming station, the multilayer toner images are fixed to the sheet P by a fixing apparatus (unshown). More concretely, after the transfer of the multilayered toner images onto the sheet P of recording medium, the sheet P is introduced into the fixing apparatus, and is conveyed through the fixing apparatus. While the sheet P is conveyed through the fixing apparatus, heat and pressure is applied to the toner images on the sheet P, whereby the multilayered toner images, different in color, are fixed to the sheet P while being fused into a full-color toner image.

The second transfer residual toner, that is, the toner remaining on the intermediary transfer belt 6 after the second transfer, is electrostatically removed and recovered by a pair of electrostatic cleaning devices 12*a* and 12*b*. The image forming apparatus is also provided with a web-based cleaning device 37, which is on the downstream side of the electrostatic cleaning devices 12*a* and 12*b* in terms of the circular movement of the intermediary transfer belt 6. The web 37*a* of the cleaning device 37 is placed in contact with the outward surface of the intermediary transfer belt 6 to remove the adherents, such as external toner additives, paper dust, and the like, on the outward surface of the intermediary transfer belt 6. After the cleaning of the intermediary transfer belt 6, that is, after the second transfer residual toner and the other adherents, are removed from the intermediary transfer belt 6, the cleaned portion of the intermediary transfer belt 6 is used again for the first transfer. In other words, the intermediary transfer belt 6 is repeatedly used for the first transfer.

[Intermediary Transfer Belt]

As described above, the monochromatic toner images, different in color, formed on the photosensitive drums (image forming members) 1Y, 1M, 1C, and 1Bk, one for one, are transferred (first transfer) onto the intermediary transfer belt 6. Then, the four monochromatic toner images on the intermediary transfer belt 6 are transferred (second transfer) onto the sheet P of recording medium. The intermediary transfer belt 6, that is, the means from which the four monochromatic toner images, different in color, are transferred onto the sheet P of recording medium, an endless belt, comprises a substrate and an elastic layer. More concretely, the intermediary transfer belt 6 has three layers, which are a resin layer, an elastic layer, and a surface layer. As the material for the resin layer, poly-carbonate, fluorinated resins (ETFE, PVDF), polystyrene, and the like, for example, can be used. As the elastic material (elastic rubber, elastomer) for the elastic layer, butyl rubber, fluorinated rubber, acrylic rubber, and the like, for example, can be used. There is no strict requirement for the material for the surface layer, except that the material for the surface layer is required to have such properties that can improve the intermediary transfer belt 6 in second transfer efficiency by minimizing the toner adhesion to the surface of the intermediary transfer belt 6. As for the examples for the material for the surface layer, resinous substances such as polyurethane, polyester, epoxy resins, and the like, for example, are usable. However, the material for the surface layer does not need to be limited to those mentioned above.

Providing the intermediary transfer belt 6 with an elastic layer improves the intermediary transfer belt 6 in transfer efficiency. That is, not only can it reduce the amount by which toner remains on the intermediary transfer belt 6 after the second transfer, but also, it can make it possible for the image forming apparatus to yield images of higher quality, more specifically, images having virtually no missing spots or areas. Further, it can also improve the intermediary transfer belt 6 in the efficiency with which a toner image is transferred from the intermediary transfer belt 6 onto a sheet of recording medium which is thick and/or irregular in surface texture.

[Structure of Second Transfer Station]

The second transfer station T2, which is the transfer station for transferring the monochromatic toner images from the intermediary transfer belt 6 onto the sheet P of recording medium, comprises the second transfer roller 9 and backing roller 21, as described previously. The second transfer roller 9 is made up of a metallic core, and an elastic layer formed of ion-conductive foamed rubber (NBR). It is 24 mm, for example, in external diameter, 6.0–16.0 (μm) in surface roughness (Rz), and 1E+5–1E+8Ω in electrical resistance (N/N: 23° C., 50% in RH, and 2 kV in applied voltage). In this embodiment, the secondary transfer roller 9 is grounded. Incidentally, if the peripheral surface of the secondary transfer roller 9 is no more than 1.5 μm in roughness, the secondary transfer roller 9 is unsatisfactory in terms of the recording medium conveyance performance. Thus, the secondary transfer roller 9 is desired to be manufactured so that it is no less than 1.5 μm (Rz>1.5 μm), preferably, no less than 6 μm (Rz>6 μm), in surface roughness Rz.

The image forming apparatus is also provided with a fur brush 25 and a metallic roller 26, which are in the adjacencies of the second transfer roller 9. The fur brush 25 is in contact with the secondary transfer roller 9, whereas the metallic roller 26 is on the opposite side of the fur brush 25 from the secondary transfer roller 9, being in contact with the fur brush 25. The fur brush 25 is rotated at 75 rpm, for example, in the opposite direction from the direction in which the secondary transfer roller 9 is rotated. It is 18 mm in overall external diameter, and 1E+5–1E+6Ω in electrical resistance N/N (23° C., 50% in RH, and 100 V in applied voltage). The fur brush 25 is positioned so that it appears as if the secondary transfer roller 9 is intruding into the fur brush 25 by a preset distance (1.5-2.0 mm, for example). That is, the second transfer roller 9 and fur brush 25 are positioned so that the distance between the peripheral surface of the secondary transfer roller 9 and the axial line of the fur brush 25 is less by a preset amount (1.5-2.0 mm, for example) than the overall radius (radius inclusive of fur portion) of the fur brush 25 (9 mm, for example).

The metallic roller 26 also is positioned as if it is intruding by a preset distance into the fur brush 25. The metallic roller 26 is 13 mm, for example, in external diameter. To the metallic roller 26, high voltage, which is being controlled so that a preset amount (+0.5-15 μA) of current flow through the metallic roller 26, is applied to remove and recover the toner on the peripheral surface of the secondary transfer roller 9. After the second transfer residual toner is recovered onto the metallic roller 26, it is removed from the metallic roller 26 by a blade 27.

The backing roller 21 also is made up of a metallic core and an elastic layer, like the secondary transfer roller 9. The electric power source 46 is in connection to the metallic core of the backing roller 21. As the second transfer bias is applied to the backing roller 21 from the electric power source 46, electric current flows between the backing roller 21 and secondary transfer roller 9, whereby the toner images on the intermediary transfer belt 6 are transferred (second transfer) onto the sheet P of recording medium. Incidentally, the electric power source 46 may be connected to the secondary transfer roller 9. In the case where the electric power source 46 is connected to the secondary transfer roller 9, the backing roller 21 is to be grounded. Further, it does not need to be electrostatically that the secondary transfer roller 9 is cleaned. For example, a blade or the like may be used to clean the secondary transfer roller 9.

[Electrostatic Cleaning Device]

As described above, after the transfer (second transfer) of the toner images onto the sheet P of recording medium from the intermediary transfer belt 6, a certain amount of toner remains on the intermediary transfer belt 6 (intermediary transfer member). This transfer residual toner is electrostatically removed by the electrostatic cleaning devices 12*a* and 12*b*. The intermediary transfer belt 6 in this embodiment is provided with an elastic layer. Thus, its surface portion is relatively soft. As the belt cleaning member for removing the residual toner on the intermediary transfer belt 6, it is possible to use a cleaning blade. However, the surface portion of the intermediary transfer belt 6 in this embodiment is relatively soft. Therefore, an electrostatic cleaning device, that is, a cleaning device which electrostatically removes the residual toner, is preferable to a cleaning blade.

The electrostatic cleaning devices 12*a* and 12*b* are sequentially arranged in the direction of the circular movement of the intermediary transfer belt 6. The electrostatic cleaning devices 12*a* and 12*b* have fur brushes 12*a*1 and 12*b*1 and metallic rollers 12*a*2 and 12*b*2, respectively. The metallic rollers 12*a*2 and 12*b*2 are in connection to electric power sources 12*a*3 and 12*b*3, respectively. Further, the image forming apparatus has rollers 12*a*4 and 12*b*4, which are inside the loop the intermediary transfer belt 6 forms. The rollers 12*a*4 and 12*b*4 are in contact with the inward surface of the intermediary transfer belt 6, and oppose the electrostatic cleaning devices 12*a* and 12*b*, with the presence of the intermediary transfer belt 6 between the rollers 12*a*4 and 12*b*4 and electrostatic cleaning devices 12*a* and 12*b*. The rollers 12*a*4 and 124*b* are grounded.

The fur brushes 12*a*1 and 12*b*1 rotate at 70 rpm, for example, in the opposite direction from the direction of the circular movement of the intermediary transfer belt 6. They are 5 mm in bristle strand length, 11 mm in metallic core diameter, 21 mm in overall diameter, and 1E+7-5E+8Ω in electrical resistance N/N (23° C., 50% RH, and 300 V in applied voltage), for example. They are positioned so that it appears as if the intermediary transfer belt 6 is intruding into the fur brushes 12*a*1 and 12*b*1 by a preset distance (1.5-2.0 mm, for example). That is, they are positioned so that the distance between the outward surface of the intermediary transfer belt 6 and the axial line of each of the fur brushes 12*a*1 and 12*b*1 is less by a preset amount (1.5-2.0 mm, for example) than the overall radius (radius inclusive of fur portion) of each of the fur brushes 12*a*1 and 12*b*1.

Further, the metallic rollers 12*a*2 and 12*b*2 also are positioned so that it appears as if the metallic rollers 12*a*2 and 12*b*2 are intruding into the fur brushes 12*a*1 and 12*b*1, respectively, by a preset distance. The metallic rollers 12*a*2 and 12*b*2 are 20 mm, for example, in external diameter. The electrostatic cleaning device 12*a* is on the upstream side of the electrostatic cleaning device 12*b* in terms of the circular movement of the intermediary transfer belt 6. To the electric power source 12*a*3 of the electrostatic cleaning device 12*a*, high voltage (cleaning bias voltage), which is being controlled so that it remains stable in magnitude (−2,000-−3,500 V (−45-−70 uA), for example) is applied. To the electric power source 12*b*3 of the electrostatic cleaning device 12*b*, high voltage (cleaning bias), which is being controlled so that it remains stable in magnitude (+1,000-+3,500 V (+5-+25 uA), for example) is applied. That is, the voltage applied to the electrostatic cleaning device 12*a*, that is, the upstream one, and the voltage applied to the electrostatic cleaning device 12*b*, that is, the downstream one, are opposite in polarity.

That is, the residual toner on the intermediary transfer belt 6 is electrostatically removed and recovered by the fur brushes 12*a*1 and 12*b*1. More specifically, the residual toner on the intermediary transfer belt 6 is removed, and is recovered onto the electric power source 12*a*1 and 12*b*1, by the electrostatic force generated by applying the cleaning bias to the electrostatic cleaning devices 12*a* and 12*b*. After the residual toner is recovered by the electric power source 12*a*1 and 12*b*1, it is recovered by the metallic rollers 12*a*2 and 12*b*2, and then, is removed from the metallic rollers 12*a*2 and 12*b*2 by the blades 12*a*5 and 12*b*5.

[Web-based Cleaning Device]

The image forming apparatus is provided with the web-based cleaning device 37, which is on the downstream side of the above-described electrostatic cleaning devices 12*a* and 12*b* in terms of the circular movement of the intermediary transfer belt 6. The web-based cleaning device 37 comprises a roll of web 37*a*, a contact roller 37*b*, a supply roller 37*c*, and a take-up roller 37*d*. The web-based cleaning device 37 rubs away the adherents on the intermediary transfer belt 6, by placing its web 37*a* in contact with the intermediary transfer belt 6. In order to remove the adherents on the intermediary transfer belt 6, one end of the web 37*a* is attached to the supply roller 37*c*, and the other end of the web 37*a* is attached to the take-up roller 37*d*, being stretched between the supply roller 37*c* and take-up roller 37*d* and wrapping halfway around the contact roller 37*b* in such a manner that it is placed in contact with the intermediary transfer belt 6. More specifically, the web 37*a* is placed in contact with the intermediary transfer belt 6 by the contact roller 37*b* so that a preset amount (2.0 kg in total pressure) is maintained between the web 37*a* and intermediary transfer belt 6. In this embodiment, the web-based cleaning device 37 is positioned so that it opposes the driver roller 22 with the presence of the intermediary transfer belt 6 between the web-based cleaning device 37 and driver roller 22. However, it may be against one of the belt suspending rollers other than the driver roller 22 that the web-based cleaning device 37 is positioned to oppose.

As for the material for the web 37*a*, one or more among unwoven cloths made of polyester, acrylic, vinyl, water soluble vinyl, rayon, Nylon, poly-propylene, cotton, etc., may be used. However, the material for the web 37*a* does not need to be limited to those listed above. As the external toner additives, such as $SiO_2$, $TiO_2$, and the like, separate from the toner particles, they are adhered to (rubbed onto) the surface of the intermediary transfer belt 6 in the transfer stations or the like, in which they are subjected to pressure. Once these external toner additives are adhered to the surface of the intermediary transfer belt 6 by being rubbed onto the intermediary transfer belt 6, they cannot be recovered by the electrostatic cleaning means 12*a* and 12*b*. Therefore, they are mechanically removed by the web 37*a* of the web-based cleaning device 37.

If the same surface of the web 37*a* is used longer than a certain length of time, the amount of the adherents on the web 37*a* exceeds the adherent recovery capacity of the web 37*a*. Thus, some of the adherents adhered to the web 37*a* are rubbed back onto the intermediary transfer belt 6. In other words, the web 37*a* reduces in adherent removal performance. Thus, if the length of time a given portion of the web 37*a* is used for cleaning exceeds a preset length of time, the web 37*a* is taken up (rolled up) by the take-up roller 37*d* by a preset length while unwinding the web 37*a* from the supply roller 37*c* by the preset length so that the used portion of the web 37*a*, that is, the portion of the web 37, which has been in contact with the intermediary transfer belt 6, is replaced by the fresh portion (unused portion) of the web 37*a*. In this embodiment, the timing with which the web 37*a* is taken up, and the length by which the web 37*a* is taken up (wound up), are set so that the web 37*a* is taken up by 5 mm for every 10 sheets of A4 size, for example. With this arrangement, it is possible to satisfactorily remove the adherents on the surface of the intermediary transfer belt 6. Incidentally, even though in this embodiment, the web-based cleaning device 37 which employs the web 37*a* is employed for removing the adherents on the intermediary transfer belt 6, the means for cleaning the intermediary transfer belt 6 may be a cleaning means other than the web-based cleaning device 37, as long as it is structured so that it removes the adherents on the intermediary transfer belt 6 and internally captures the removed adherents.

[Main Assembly Environment Sensor]

The image forming apparatus in this embodiment is provided with a main assembly environment sensor 41 (first ambience condition sensor) for detecting the internal temperature and humidity of the main assembly of the image forming apparatus, more specifically, the external temperature and humidity of each of the developing devices 4Y, 4M, 4C, and 4Bk. The main assembly environment sensor 41 is within the main assembly of the image forming apparatus. The CPU 42 calculates the absolute amount of moisture in the adjacencies of each of the developing devices 4Y, 4M, 4C, and 4Bk by referencing the values obtained by the main assembly environment sensor 41 with the conversion table stored in a ROM, with the main assembly environment detection circuit 41*a*.

[Developing Device Interior Environment Sensor]

Figure 2:
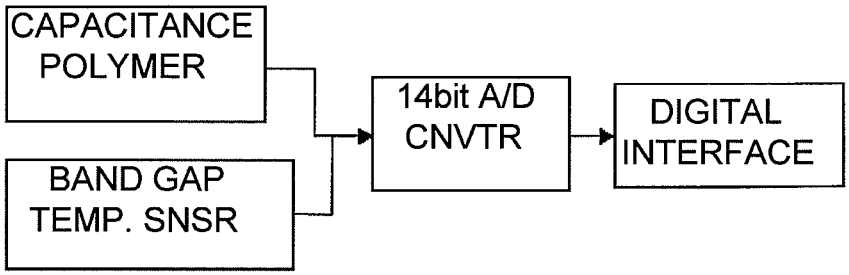
FIG. 2 is a block diagram illustrating a structure of an ambient condition sensor for detecting the ambience in the developing device.

Each of the developing devices 4Y, 4M, 4C, and 4Bk is provided with a developing device interior environment sensor 40 (second environment detecting means) for detecting the internal temperature and humidity of the developing device 4. The sensor 40 is within the external shell of the developing device 4. As the sensor 40, a temperature/humidity sensor SHT1X (product of Sensirion Co., Ltd.), for example, is used. Referring to FIG. 2, this environment sensor 40 has a humidity detecting portion and a temperature detecting portion. The humidity detecting portion is of the type which detects the electrostatic capacity of polymer. The temperature detecting portion is a band gap temperature sensor. Both the humidity and temperature detecting, devices are CMOS devices, which serially outputs temperature and humidity signals through a digital interface.

The temperature sensor of the band gap type, as a temperature detecting device, employs a thermistor, the electrical resistance of which linearly changes in relation to temperature, so that the interior temperature of the developing device can be calculated from the electrical resistance of the thermistor. As for the humidity detecting portion, it is a condenser, the dielectric component of which is made of polymer. The polymer layer changes in the amount by which moisture adhere to the polymer layer, in response to the change in the ambient humidity. Thus, the interior humidity of the developing device can be obtained by converting the detected electrostatic capacity of the polymer layer, based on the fact that the electrostatic capacity of the condenser (in reality, sensor (product of Sensirion Co., Ltd.) detects electrical resistance) linearly changes in relation to the ambient humidity of the condenser.

Referring to FIG. 1, the developing device interior environment sensor 40 for detecting the internal temperature and humidity of the developing device 44 is position in each of the developing devices 4Y, 4M, 4C, and 4Bk so that it remains buried in the body of toner in the developing device 4. Thus, it detects the temperature and humidity of the toner in the developing device 4 while remaining in contact with the toner. It calculates the relative humidity of the toner through the developing device interior environment detection circuit 40*a* in the developing device 4.

[Toner Image Detection Optical Sensor]

The image forming apparatus in this embodiment is also provided with a toner image detection optical sensor 17, as a toner image detecting means, which is provided for adjusting the image forming apparatus in color deviation. The optical sensor 17 is positioned in such a manner that it opposes the portion of the surface of the intermediary transfer belt 6, which is between the image forming station Bk and tension roller 20 in terms of the moving direction of the intermediary transfer belt 6. The optical sensor 17 is of the positive reflection type. It has a light emitting portion and a light catching portion. It detects the presence of a toner image on the intermediary transfer belt 6, by detecting the amount of the light reflected by the intermediary transfer belt 6. More specifically, the light emitting portion is an LED which is 760 nm in wavelength. It is positioned so that the angle between the beam of light it emits, and the surface of the intermediary transfer belt 60, becomes 30°, for example. The light catching portion is positioned so that it catches the beam of light projected from the light emitting portion and reflected by the surface of the intermediary transfer belt 6; the angle between the line connecting the point of the surface of the intermediary transfer belt 6, upon which the beam of light from the light emitting portion hits, and the surface of the intermediary transfer belt 6, is 150°, for example.

Figure 3:
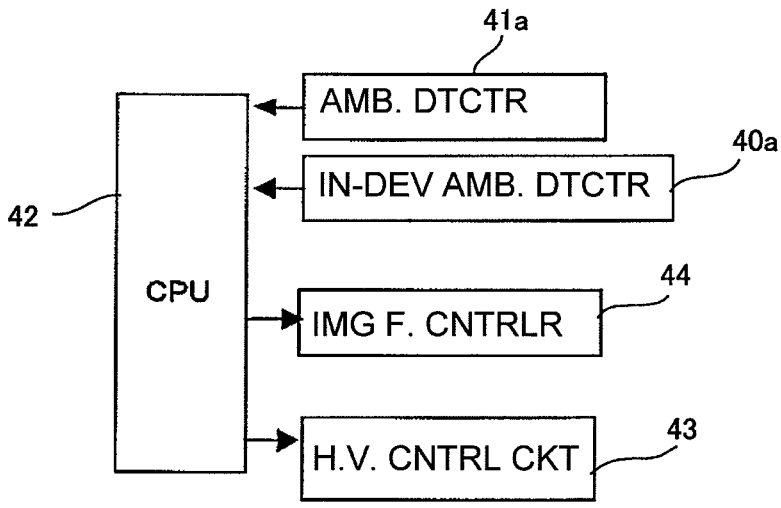
FIG. 3 is a block diagram of a transfer bias control.
Figure 4:
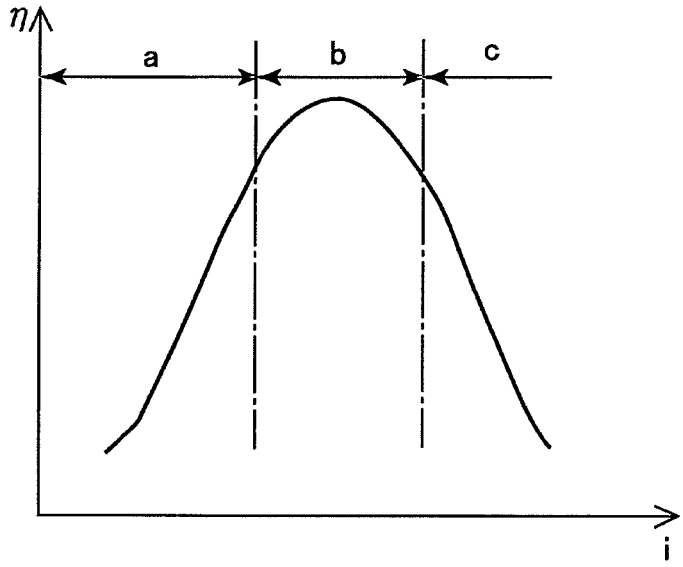
FIG. 4 illustrates a relation between a transferring current and a transfer efficiency.
Figure 4:
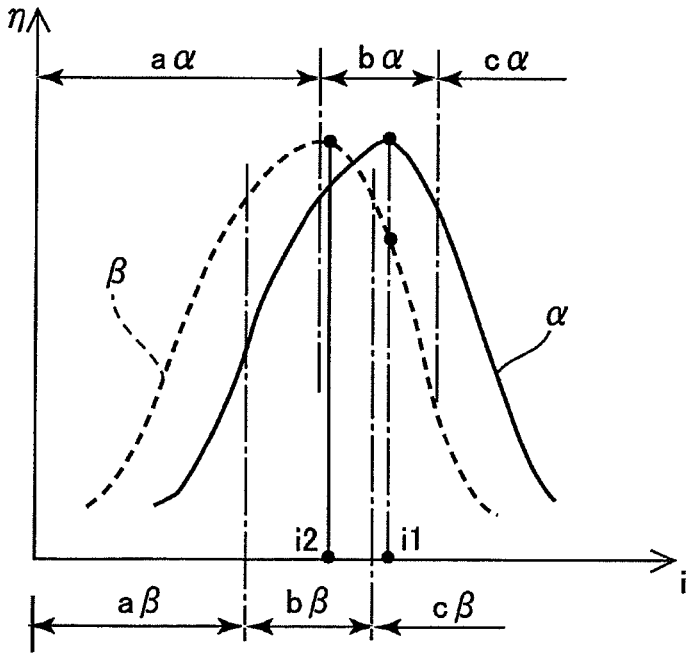
Figure 5:
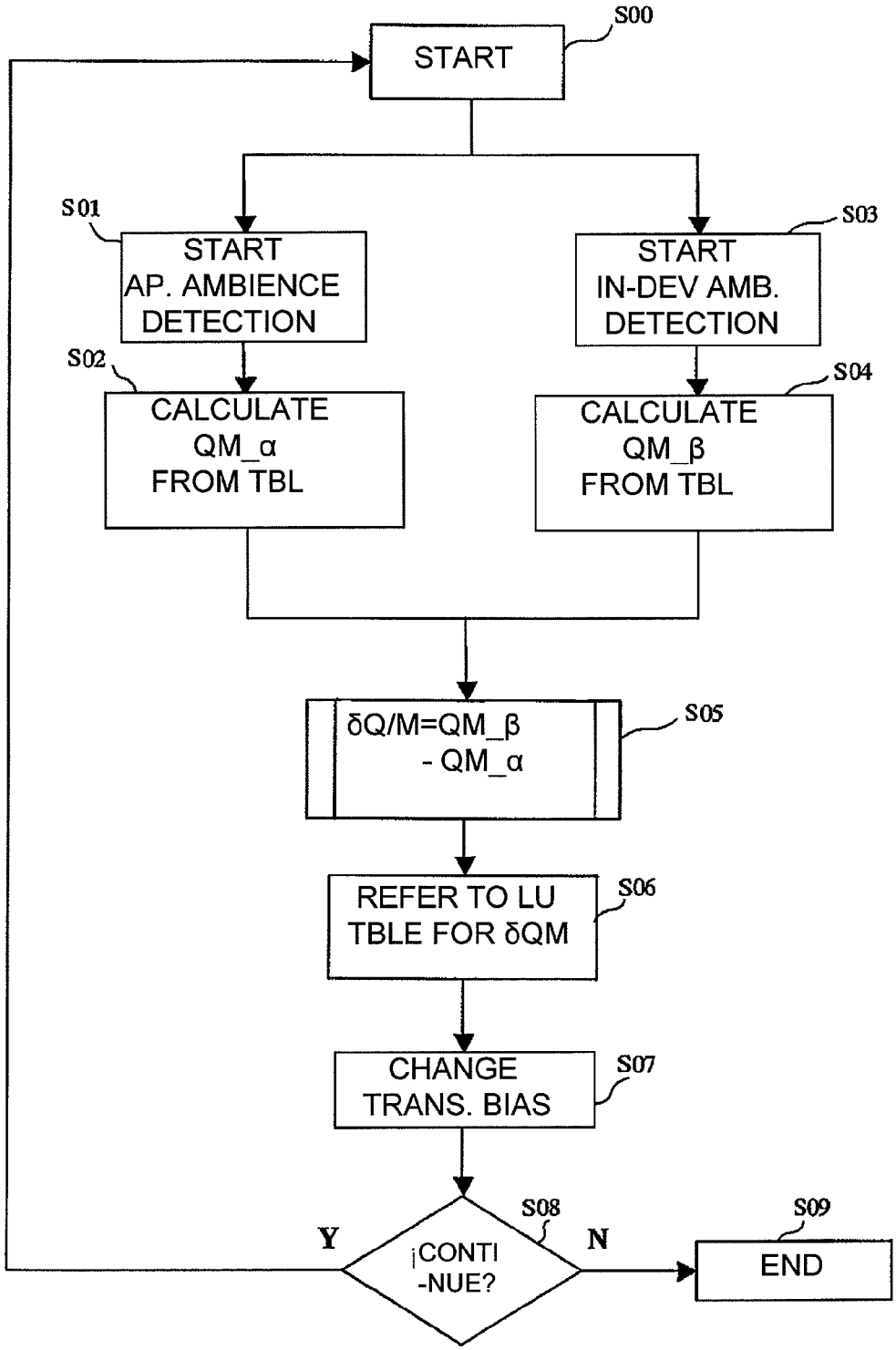
FIG. 5 is a flowchart of the transfer bias control.

In this embodiment, a monochromatic image of a test patch is formed on the photosensitive drum 1, and is transferred on the intermediary transfer belt 6, in each image forming station. Then, each monochromatic image of the test patch, on the intermediary transfer belt 6, is detected by the toner image detection optical sensor 17 described above. Then, based on the results of this toner image detection, each image forming station is controlled in image formation timing by the CPU 42 through the image formation control circuit 4, as shown in FIG. 3, in order to prevent each image forming station from forming a toner image, which is deviant in color, during an actual image forming operation.

[Transfer Bias Control]

Next, the transfer bias control in this embodiment is described. The control of the first transfer bias, and the control of the second transfer bias, are basically the same. Therefore, the control of the second transfer bias is described as an example of the transfer bias control. The image forming apparatus in this embodiment has the CPU 42 (central processing unit) which is the controlling means for controlling the second transfer bias, that is, the transfer bias to be applied to the second transferring means, and the first transfer bias, that is, the transfer bias to be applied to the first transferring means. Referring to FIG. 3, the CPU 42 is in connection to the main assembly environment detection circuit 41*a*, developing device interior environment detection circuit 40*a*, image formation control circuit 44, and transfer bias control circuit 43. The CPU 42 is controlled by a control program. It obtains signals which reflect the internal temperature, humidity, etc., of the main assembly of the image forming apparatus, and the internal temperature and humidity of the developing device, from the circuits 41*a* and 40*a*, respectively, and outputs the signals for forming the monochromatic toner images Y, M, C, and Bk colors, to the image formation control circuit 44. Further, at the same time, the CPU 42 properly controls the transfer biases by sending transfer bias control signals to the transfer bias control circuit 43.

In this embodiment, the transfer biases are controlled as follows: First, the CPU 42 determines the amount by which transfer current is to be flowed through the second transferring means, based on the absolute amount of the internal moisture in the apparatus calculated by the main assembly environment detection circuit 41*a* from the values detected by the main assembly environment sensor 41, which is the first environment detecting means. That is, the absolute amount of moisture in the apparatus main assembly affects the impedance of the components of the second transferring means, and the impedance of recording medium. It also affects the amount of the toner charge in the developing device. Therefore, the CPU 42 predicts the abovementioned impedances and the amount of toner charge, and then, decides the amount by which transfer current is to be flowed. This decision is made with reference to the tables, etc., which show the relationship among the absolute amount of the moisture, impedance of the components of the second transferring means, and the impedance of recording medium, and amount of toner charge. The tables, etc., are stored in the CPU 42.

However, in the case where the amount of toner charge is predicted based on the environmental condition detected by the main assembly environment sensor 41, there is a certain amount of difference between the predicted amount of toner charge and the actual amount of toner charge, because the main assembly environment sensor 41 is positioned away from the developing device, that is, the actual location in which the toner is present. The presence of this difference makes it impossible for the CPU 42 to determine the proper amount by which the transfer current is to be flowed. Moreover, the actual amount of toner charge is significantly affected by the operational mode, or the like, of the image forming apparatus. That is, if the toner in the developing device is left unattended for a long period of time after the preceding usage of the image forming apparatus, and/or the image forming apparatus is used to continuously form a substantial number of images (copies) at a high level of duty, the actual amount of toner charge will be significantly different from the predicted amount of toner charge, that is, the value in the afore-mentioned table. This difference causes the CPU 42 to predict the amount by which the second transfer current is to be flowed to be significantly different from the proper one.

In particular, in the case where the amount by which transfer current is to be flowed is predicted to be an amount which makes the transfer efficiency higher than the proper range, the second transfer residual toner, that is, the toner which remains on the intermediary transfer belt 6 after the second transfer, will be significantly greater in the amount of charge compared to when the amount by which the transfer current is flowed is proper. Thus, it becomes impossible for the electrostatic cleaning devices 12*a* and 12*b* to satisfactorily remove and recover the transfer residual toner. Next, this problem is described with reference to FIG. 4(A), which is a graph which shows the relationship between the amount of the transfer current and transfer efficiency η. In this graph, a range b, which is between the two single-dot chain lines, is the proper transfer current range, that is, the transfer current range in which the transfer efficiency is in a preferable range.

In the case where the transfer current is in a range a, in which the transfer current is smaller than a proper value, the developing device is low in transfer efficiency. Therefore, there will be a large amount toner on the intermediary transfer belt 6 after the transfer. In this case, however, the amount of charge of the transfer residual toner is no higher than the proper one. Therefore, the transfer residual toner can be satisfactorily recovered by the electrostatic cleaning devices 12*a* and 12*b*. On the other hand, in the case where the amount of the transfer current is in a range c, in which the transfer current is greater than the proper value, the second transfer station is low in transfer efficiency. Therefore, the amount by which toner remains on the intermediary transfer belt 6 will be significantly greater than the normal amount of the second transfer residual toner, and also, the residual toner will be higher in the amount of toner charge. Therefore, it will be difficult for the transfer residual toner to be recovered by the electrostatic cleaning devices 12*a* and 12*b*.

For the reason given above, the problem with which this embodiment is concerned is the range c. Thus, the object of this embodiment is to control the image forming apparatus (developing devices) to prevent the amount of the transfer current from falling into this range c. In this embodiment, therefore, in order to achieve this object, the developing device interior environment sensor 40, which is the second environment detecting means, is positioned in the developing device, that is, the very place in which toner is present. With the sensor 40 positioned in the developing device, the relative humidity of the very environment in which toner is present is accurately detected, and therefore, the amount of toner charge can be accurately predicted. Therefore, the proper amount by which the transfer current is to be flowed can be predicted. More concretely, the CPU 42 compares the amount (first amount) of toner charge predicted based on the results of the environment detection by the main assembly environment detection sensor 41, with the amount (second amount) of toner charge predicted based on the results of environment detection by the developing device environment sensor 40, that is, the environment sensor in the developing device. That is, the CPU 42 contains tables which correspond to the results of environment detection by the first and second sensors 41 and 40. Thus, it compares the first and second amounts of toner charges predicted with reference to the tables. If the second amount of toner charge is no more than the first amount of toner charge, the CPU 42 adjusts the predicted amount by which the transfer current is to be lowered, according to the above-described difference between the first and second amounts of toner charge, so that the above-described predicted amount by which transfer current is to be flowed is reduced by the amount proportional to the difference between the first and second amounts of toner charge. That is, the CPU 42 controls the transfer bias so that the amount by which transfer current is to be flowed through the second transferring means will be the adjusted amount.

Next, the above-described control is described in detail referring to FIG. 4(B), which represents the case in which the second amount of toner charge, that is, the amount of toner charge predicted based on the results of environment detection by the developing device interior environment sensor 40, is less than the first amount of toner charge, that is, the amount of toner charge predicted based on the results of environment detection by the main assembly environment sensor 41. That is, FIG. 4(B) represents the case in which the first amount of toner charge predicted based on the results of environment detection by the main assembly environment sensor 41 is greater than the second amount of toner charge, which is closer to the actual amount of toner charge. In FIG. 4(B), a solid line α shows the relationship between the transfer current i and transfer efficiency η when the amount of toner charge is the first amount, whereas a broken line β shows the relationship between the transfer current i and transfer efficiency η when the amount of toner charge is the second amount. Further, a range bα is where the amount of transfer current is proper when the relationship between the transfer current i and transfer efficiency β is as shown by the solid line α, and a range aα is where the amount of transfer current is less than the proper range. A range cα is where the transfer current i is greater than the proper range. Further, when the relationship between the transfer current i and transfer efficiency η is as shown by a dotted line β, a range bβ is where the transfer current is proper, and a range aβ is where the transfer current is below the proper range. Further, a range cβ is where the transfer current is above the proper range.

The solid line α shows the relationship between the transfer current and transfer efficiency when the amount of toner charge is the first amount, which is greater than the second amount. Therefore, the proper transfer efficiency range bα is in a range in which the amount of the transfer current is greater than the amount of the transfer current when the relationship between the transfer current and transfer efficiency is as shown by the chain line β which corresponds to the second amount of toner charge. That is, when the toner is large in the amount of charge, the toner cannot be fully transferred unless the transfer current is increased. This is why the range in which the transfer current is larger becomes the proper range. If it is only the first amount of toner charge, that is, the amount predicted based on the results of environment detection by the main assembly environment sensor 41, that is taken into consideration, the optimum amount for the transfer current is the amount i1, as indicated by the solid line α in FIG. 4(B).

However, if the transfer current i is flowed by the amount i1, the amount of the transfer current falls within the range cβ of the chain line β. The range cβ is where the amount of the transfer current is above the proper range bβ. Further, as described above, the second amount of toner charge is closer to the actual amount of toner charge than the first amount of toner charge. Therefore, if the transfer current i1 is flowed without modification, the transfer efficiency falls outside the proper range. Thus, a large amount of toner will remain on the intermediary transfer belt 6 after the transfer. In addition, because the transfer current is large, the residual toner is large in the amount of charge. Thus, in this embodiment, the CPU 42 controls the transfer bias so that the transfer current reduces from the transfer current it to the transfer current i2, which is in the proper range bβ of the chained line β.

As described above, FIG. 4 is for describing the concept of the transfer bias control in this embodiment. The actual control of the transfer bias by the CPU 42 is described with reference to the flowchart in FIG. 5. As the CPU 42 receives an image formation start signal in S00, it begins to detect the developing apparatus environment with the use of the main assembly environment sensor 41, in S01. Then, it calculates (predicts) the first amount QMα of charge for all toners, different in color, based on the absolute amount of moisture (or relative humidity), and Table 1, in S01.

TABLE 1

| Moisture (g/kg) | First toner charge amount |
|---|---|
| <0.86 | 40 |
| ≧0.86 & <1.73 | 38 |
| ≧1.73 & <5.8 | 33 |
| ≧5.8 & <8.9 | 30 |
| ≧8.9 & <15 | 27 |
| ≧15 & <18 | 26 |
| ≧18 | 25 |

At the same time, the CPU 42 begins to detect the developing device environment with the use of the developing device interior environment sensor 40, in S03. Then, based on the data from the sensor 40, and Table 2 which shows the relationship between the relative humidity and second amount of toner charge, the CPU 42 predicts the second amount QMβ of toner charge, in S04.

TABLE 2

| Relative humidity (%) | Second toner charge amount |
|---|---|
| ≧2.5 & <5 | 40 |
| ≧5 & <15 | 38 |
| ≧15 & <25 | 33 |
| ≧25 & <45 | 30 |
| ≧45 & <52 | 27 |
| ≧52 & <60 | 26 |
| ≧60 | 25 |

Then, the CPU 42 calculates (predicts) the amount δQ/M of deviation in the amount of toner charge, that is, the amount of difference between the second amount of toner charge and first amount of toner charge, S05 (Equation 1).

$$\delta Q/M = QM\beta - QM\alpha \quad (1)$$

The object of this embodiment is to prevent the problem that because the second amount of toner charge, that is the amount of toner charge in the developing device, is smaller than the first amount of toner charge predicted based on the data from the main assembly environment sensor 41, the second transfer bias (transfer current) is improperly set, which results in the formation of an image which suffers from very conspicuous unwanted spots (areas). Therefore, it is when the value of the amount δQ/M of the difference between the first and second amounts of transfer current, obtained by Equation (1) is no larger than zero, that is, when the second amount of toner charge is no more than the first amount of toner charge that the CPU 42 adjusts the transfer bias.

As for an example of the above-mentioned adjustment (control) based on the calculated (predicted) value of the amount δQ/M, if the ambient temperature and humidity of the image forming apparatus is 20° C. and 60%, the main assembly environment sensor 41 detects "dry air" (8.73 g of moisture per unit weight (1 kg) of air). Thus, the CPU 42 determines from Table 1 that the amount QMα is 30. Then, based on this first amount of toner charge, the CPU 42 determines (predicts) the proper amount of transfer current which matches the impedances of the structural components of the second transferring means and sheet P of recording medium. The reason why the proper amount of transfer current is determined (predicted) based on the results of environment detection by the main assembly environment sensor 41 is that the impedance of the structural components of the backing roller 21 and second transfer roller 9, and the impedance of the sheet P of the recording medium, can be more accurately predicted based on the results of environment detection by the main assembly environment sensor 41 than based on the results of environment detection by the developing device interior environment sensor 40. That is, the developing device interior environment sensor 40 is in the developing device. Further, the external environment of the developing device is different from the internal environment of the developing device. Therefore, it is difficult to accurately predict the impedance of the structural components of the backing roller 21 and second transfer roller 9, and the impedance of the sheet P of the recording medium, based on the results of environment detection by the developing device interior environment sensor 40. In comparison, the main assembly environment sensor 41 is outside the developing device, and therefore, can detect the environment (ambient temperature and humidity) in which the second transferring means and sheet P of recording medium are present. Thus, the above-described impedances can be more accurately predicted based on the results of environment detection by the main assembly environment sensor 41 than based on the developing apparatus interior environment sensor 40.

On the other hand, if the developing device interior environment sensor 40 begins to detect the internal environment of the developing device, and the detected internal temperature and humidity of the developing device are 30° C. and 45% RH, respectively, the value of the amount QMβ is 27, based on Table 2 which shows the relationship between the relative humidity and the amount QMβ of toner charge. Thus, the value of the amount δQ/M, which is obtained from Equation 1 is −3 (27−30).

Then, the CPU 42 calculates the amount δQ/M of environmental deviation for each of the color toners M, C, Y, and Bk, and selects the negative value which is largest in absolute value (in the minus side), as the amount of the environmental deviation of toner charge. Then, it changes the amount by which transfer current is to be flowed, based on the Table 3, in S07. That is, the CPU 42 subtracts an amount which corresponds to the amount of the environmental deviation of toner charge, from the amount by which transfer current is to be flowed according to the predicted amount of transfer current.

TABLE 3

| Zone | TNR charge amount for diff. | Decrease of trans. current |
|---|---|---|
| 1 | 0 | −5 μA |
| 2 | Larger than −1--3 | −7.5 μA |
| 3 | Larger than −3--5 | −10 μA |

TABLE 3-continued

| Zone | TNR charge amount for diff. | Decrease of trans. current |
|---|---|---|
| 4 | Larger than −5--8 | −12.5 μA |
| 5 | Not larger than −8 | −15 μA |

In Table 3, the range of the amount of environmental deviation of toner charge is divided into five zones (zones 1-5). To review the setting of the amount of transfer current, with reference to the case where δQ/M=−3, δQ/M=−3 corresponds to Zone 3. Therefore, first, the CPU 42 deducts 10 μA from the transfer current value obtained with reference to Table 1, by detecting the absolute amount of moisture. That is, the CPU 42 subtracts a preset value which is proportional to the amount of difference between the first amount of toner charge and the second amount of toner charge, from the amount of transfer current determined (predicted) based on the results of environment detection by the main assembly environment sensor 41. Then, it sets the transfer bias so that the transfer current flows by the amount equal to the thus obtained difference. In this embodiment, the transfer bias is controlled to be stable in magnitude. In other words, the transfer bias (voltage) is controlled so that the transfer current flows through the second transferring means by the amount obtained through the above-described adjustment.

Incidentally, as described above, the CPU 42 controls also the transfer voltage (high voltage) applied to the first transferring means, that is, the transferring means for transferring a toner image from each of the four photosensitive drums 1 onto the intermediary transfer belt 6, by utilizing the results of environment detection by the developing device interior environment sensor 40. Further, the adjustment may be made so that if the amount δQ/M of the environmental deviation of toner charge is positive, the transfer current increases in proportion to the amount δQ/M. With the execution of the above-described control, even if the second amount of toner charge is greater than the first amount of toner charge predicted based on the results of environment detection by the main assembly environment sensor 41, the transfer efficiency can be kept in the preferable range. As long as the transfer efficiency can be kept in the preferable range, the amount of the transfer residual toner is small, and therefore, it is ensured that the transfer residual toner can be satisfactorily removed by the electrostatic cleaning devices 12*a* and 12*b*. Thus, it is possible to reduce the problem that image forming apparatus outputs unsatisfactory images.

This embodiment makes it possible to adjust the transfer current according to the internal environment of the developing device. Therefore, even when the external environment (temperature and humidity) of the developing device is different from the internal environment (temperature and humidity) of the developing device, this embodiment can keep the transfer efficiency in the preferable range, and therefore, can reduce the amount by which toner will remain on the intermediary transfer belt 6 after the transfer. That is, even when the external environment of the developing device is different from the internal environment of the developing device, and therefore, the second amount of toner charge predicted based on the results of environment detection by the developing device interior environment sensor 40 is smaller than the first amount of toner charge predicted based on the results of environment detection by the main assembly environment sensor 41, the transfer current can be flowed by a proper amount. Therefore, not only can this embodiment prevent the problem that a large amount of toner remains on the intermediary transfer belt 6 after the second transfer, but also, it can prevent the transfer residual toner from significantly increasing in the amount of charge. Therefore, it can ensure that the transfer residual toner can be satisfactorily removed by the electrostatic cleaning devices 12*a* and 12*b*. Therefore, it can reduce the problem that the image forming apparatus outputs unsatisfactory images.

In particular, this embodiment can prevent the second transfer bias falling beyond the proper range, that is, the range in which the second transfer bias is proportional to the amount of toner charge in the developing device, and therefore, can prevent the problem that toner which is abnormally large in the amount of charge remains on the intermediary transfer belt 6 after the second transfer. That is, even if the environment outside the developing device is not the same as the environment inside the developing device, and therefore, the second amount of toner charge predicted based on the results of the environment detection by the developing device interior environment sensor 40 is smaller than the first amount of toner charge predicted based on the results of the environment detection by the main assembly environment sensor 41, this embodiment can flow the transfer current by a proper amount. Thus, not only can this embodiment prevent the problem that a large amount of toner remains on the intermediary transfer belt 6 after the second transfer, but also, it can prevent the residual toner on the intermediary transfer belt 6 from increasing in the amount of charge, and therefore, can ensure that the residual toner is satisfactorily removed by the electrostatic cleaning devices 12*a* and 12*b*. Therefore, this embodiment can prevent such a problem that the image forming apparatus outputs unsatisfactory images.

Moreover, this embodiment can reduce the amount by which toner remains on each photosensitive drum after the first transfer, by preventing the first transfer bias from exceeding the proper range, that is, the range which matches the amount of toner charge in the developing device. In other words, it can keep the transfer efficiency in the preferable range. Further, it can prevent the transfer residual toner from significantly increasing in the amount of charge, and therefore, can reduce the electrostatic attraction between the transfer residual toner and the peripheral surface of the photosensitive drum 1. Therefore, it can ensure that the transfer residual toner is satisfactorily recovered by the photosensitive drum cleaning device 11.

Further, in the case of this embodiment, even if the determined (predicted) amount by which the transfer current is to be flowed is within the range in which the transfer efficiency predicted based on the second amount of toner charge is satisfactory, the transfer current is reduced by an amount within the range in which the transfer efficiency predicted based on the second amount of toner charge remains satisfactory, as long as the first amount of toner charge is greater than the second amount of toner charge. Further, even if the first and second amounts of toner charge are equal in value, the amount by which the transfer current is to be flowed is reduced by an amount within the range in which the transfer efficiency predicted based on the second amount of toner charge is satisfactory. Thus, this embodiment can ensure that the transfer residual toner is satisfactorily removed and recovered by the electrostatic cleaning devices 12*a* and 12*b*, or photosensitive drum cleaning device 11, by ensuring that the transfer residual toner, that is, the toner which is inevitably left on the image bearing member, does not increase in the amount of charge.

Further, as long as the transfer residual toner remaining on the intermediary transfer belt 6 after the second transfer can be satisfactorily removed and recovered by the electrostatic cleaning devices 12*a* and 12*b*, it is possible to prevent a large amount of toner from being conveyed to the web-based cleaning device 37, which is on the downstream side of the electrostatic cleaning devices 12*a* and 12*b*. Therefore, the adherents such as the external toner additives can be satisfactorily removed by the web-based cleaning device 37.

Further, as long as the external toner additives and the like adherents on the intermediary transfer belt 6 can be satisfactorily removed by the web-based cleaning device 37, the intermediary transfer belt 6 can be prevented from changing in surface properties. Therefore, it is possible to prevent the accuracy with which the test patch is detected by the optical sensor 17 from lowering. Therefore, it is ensured that the image forming apparatus is properly corrected in terms of color deviation.

[First Example of Image Forming Apparatus in Accordance with Present Invention]

Next, the experiment carried out to confirm the effects of the first preferred embodiment is described. In this experiments, an image forming apparatus structured so that its transfer bias was controlled using only the main assembly environment sensor 41 (temperature/humidity sensor) to predict the amount of toner charge, was used as the comparative image forming apparatus, whereas the first example of an image forming apparatus in accordance with the present invention was structured so that its transfer bias was controlled using both the main assembly environment sensor 41 and developing device interior environment sensor 40 to predict the amount of toner charge. Both the first example of an image forming apparatus in accordance with the present invention, and comparative image forming apparatus, were tested as follows:

In the experiment, an actual version of the first example of the image forming apparatus in accordance with the present invention, and an actual version of the comparative image forming apparatus, were used several times to form images, while comparing the two versions in terms of the glossiness of the intermediary transfer belt 6 and the contamination (reflection density) of the web 37*a*. The glossiness of the intermediary transfer belt 6 was measured (70° in incidence angle) by a handy gloss-meter PG1 (product of Nippon Denshoku Co., Ltd.). The amount of contamination (reflection density) of the web 37*a* was measured by a reflection density meter (product of X-Rite Co., Ltd.). As for the conditions under which the experiment was conducted, the temperature and humidity were 23° C. and 50%, respectively. Further, the recording medium was a sheet of ordinary paper (80 gf/$m^2$), which was A3 in size. The test image was 10% in average image duty. The results of the experiment are shown in FIGS. 6 and 7.

Figure 6:
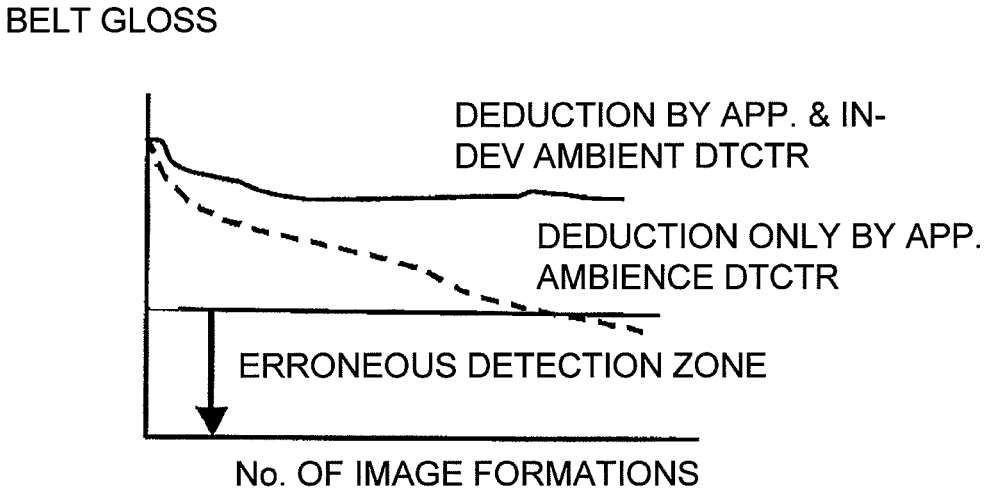
FIG. 6 illustrates a relation between the number of image formations and a glossiness of an intermediary transfer belt.
Figure 7:
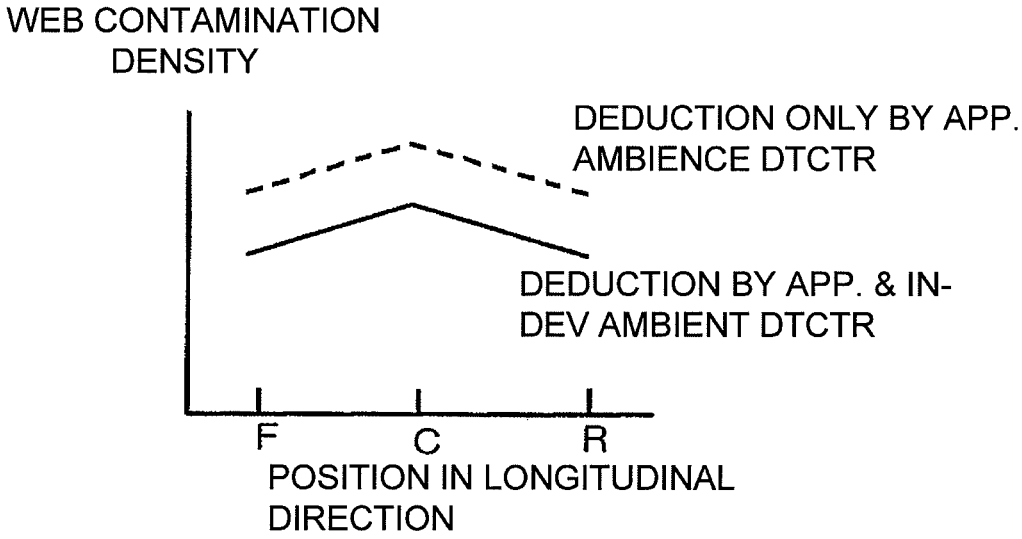
FIG. 7 illustrates a relation between a reflection density and a position of a web with respect to a longitudinal direction.

In the case of the comparative apparatus, as the image forming operation is continued (as image forming apparatus increases in number of images it formed), the intermediary transfer belt 6 reduced in glossiness, as indicated by a broken line in FIG. 6. As the intermediary transfer belt 6 reduced in glossiness, the glossiness of the intermediary transfer belt 6 fell into the range in which the optical sensor 17 for toner image detection failed to accurately detect. In other words, it became difficult for the optical sensor 17 to accurately detect the patch for image formation control. If this situation occurs, the image forming operation has to be interrupted, and the web 37*a* has to be taken up by rotating the take-up roller to place the fresh portion of the web 37*a* in contact with the intermediary transfer belt 6. Then, the intermediary transfer belt 6 has to be idled to remove the residual toner and external toner additives on the intermediary transfer belt 6. In other words, the image forming apparatus is reduced in productivity.

Further, as the glossiness of the intermediary transfer belt 6 fell to roughly 35-40% of the initial glossiness, due to the continuation of the image forming operation, the external toner additives began to firmly adhere to the intermediary transfer belt 6. Once the external toner additives firmly adhere to the intermediary transfer belt 6, the external toner additives are unlikely to be removed by the web 37*a*, even if the fresh portion of the web 37*a* is placed in contact with the intermediary transfer belt 6 and the intermediary transfer belt 6 is idled, as descried above. Thus, it becomes impossible to restore the intermediary transfer belt 6 in glossiness so that its glossiness will be above the range in which the optical sensor 17 for toner image detection fails to accurately detect the toner image. Therefore, the intermediary transfer belt 6 has to be replaced.

The reason why the intermediary transfer belt 6 reduces in glossiness is as follows: As a large amount of toner slips by the electrostatic cleaning devices 12*a* and 12*b*, and reaches the web 37*a*, it is dammed up by the web 37*a*. As a large amount of toner is dammed up by the web 37*a*, not only does the web 37*a* reduce in its ability to remove the external toner additives on the intermediary transfer belt 6, allowing thereby some of the external toner additives to slip by, but also, it rubs onto the intermediary transfer belt 6 the external toner additive which it allowed to slip by. If the image forming operation is continued while the intermediary transfer belt 6 and cleaning web 37*a* is under the above-described condition, the external toner additives continue to be adhered to the intermediary transfer belt 6, reducing thereby the intermediary transfer belt 6 in the amount by which its surface reflects light. This is why the intermediary transfer belt 6 reduces in glossiness.

On the other hand, the first example of an image forming apparatus in accordance with the present invention, represented by a solid line in FIG. 6, was slower in the rate with which the intermediary transfer belt 6 reduced in glossiness than the comparative image forming apparatus. Next, this subject is described in more detail. Referring to FIG. 7, which shows the amount of contaminants on the web 37*a* (reflection density of the web 37*a*) when the amount of toner charge was predicted using only the main assembly environment sensor 41, and the amount of contaminants on the web 37*a* (reflection density of web 37*a*) when the amount of toner charge was predicted using both the main assembly environment sensor 41 and developing device interior environment sensor 40. That is, it is evident from FIG. 7 that the comparative apparatus, represented by a broken line, was greater in the amount by which toner slipped by the electrostatic cleaning devices 12*a* and 12*b*, being therefore lower in the glossiness of the intermediary transfer belt 6, than the first example of the apparatus in accordance with the present invention, which is represented by the solid line. In other words, the first example of the image forming apparatus in accordance with the present invention was smaller in the amount by which toner slipped by the electrostatic cleaning devices 12*a* and 12*b*, being therefore smaller in the amount of toner dammed up by the web 37*a*, whereas the comparative image forming apparatus was greater in the amount of toner which slipped by the electrostatic cleaning devices 12*a* and 12*b* than the first example of the image forming apparatus in accordance with the present invention. Therefore, the intermediary transfer belt 6 of the comparative image forming apparatus reduced in glossiness faster than the image forming apparatus in accordance with the present invention. In other words, the image forming apparatus in accordance with the present invention was smaller in the amount by which toner was dammed up by the electrostatic cleaning devices 12*a* and 12*b*. Therefore, in the case of the image forming apparatus in accordance with the present invention, the glossiness of the surface of the intermediary transfer belt 6 remains relatively stable at a satisfactory level once it falls to a certain level, which still is satisfactory. Therefore, the patch for image formation control can be satisfactorily detected for the duration of the image formation.

As described above, in the case of the first example of an image forming apparatus in accordance with the present invention, the amount of toner charge was accurately predicted, and fed back to the CPU 42 to control the transfer voltage. Therefore, it was possible to reduce the amount by which toner adheres to the web 37*a*, making it thereby possible to maintain the reflectivity of the intermediary transfer belt 6 at a satisfactory level. Therefore, the patch for image formation control can be accurately detected, and therefore, it is ensured that the image forming apparatus is properly controlled.

Embodiment 2

Figure 8:
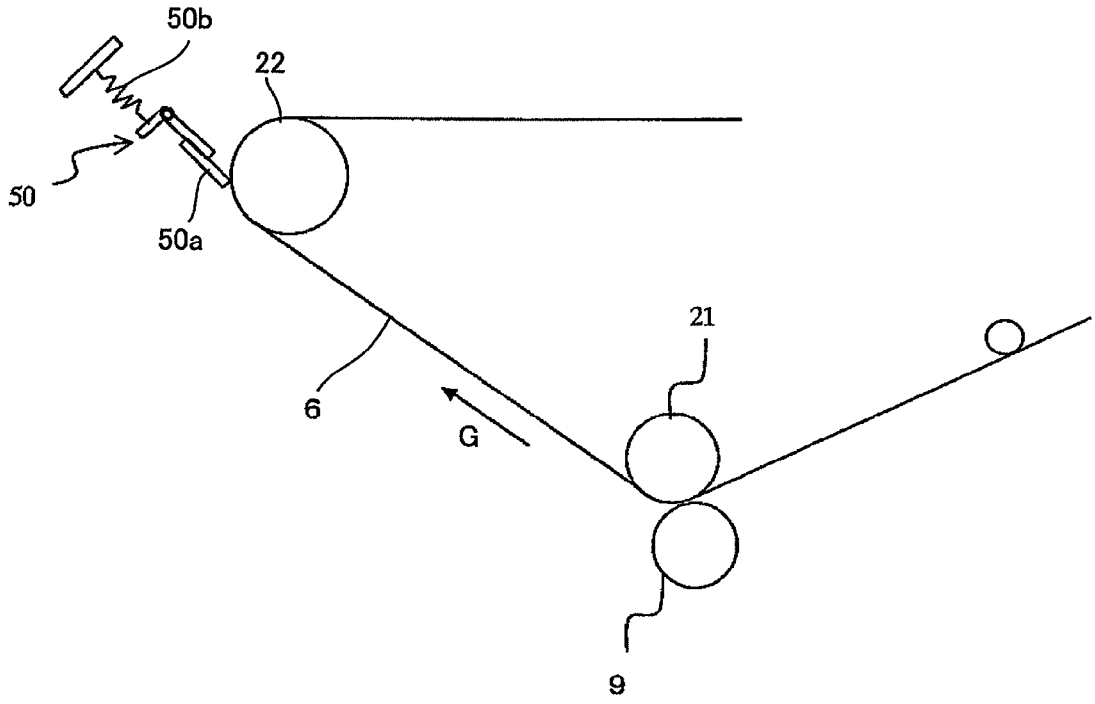
FIG. 8 is a schematic illustration of a part of the image forming apparatus according to a second embodiment of the present invention.

Next, referring to FIG. 8, the second preferred embodiment of the present invention is described. This preferred embodiment is the same as the first one, except that the image forming apparatus in this embodiment has a belt cleaning device of the contact type instead of the electrostatic cleaning devices in the first embodiment. That is, the belt cleaning device in this embodiment has a cleaning blade 50*a*. Further, the image forming apparatus in this embodiment does not have a web-based cleaning device used in the first embodiment. Otherwise, the image forming apparatus in this embodiment is the same in structure as the one in the first embodiment. Therefore, the drawings and descriptions of the image forming apparatus in this embodiment, which are the same as those of the image forming apparatus in the first embodiment, are not given, or are simplified. That is, the description of this embodiment, which is going to be given hereafter, is focused on the features of this embodiment, which are different from those of the first embodiment.

The cleaning apparatus 50, which is a cleaning apparatus of the contact type, is positioned so that it opposes the driver roller 22, with the presence of the intermediary transfer belt 6 between the apparatus 50 and driver roller 22. It has: a cleaning blade 50*a*; and a spring 50*b* which is a pressure applying means for keeping the cleaning blade 50*a* pressed upon the intermediary transfer belt 6. The cleaning blade 50*a* is a piece of urethane rubber plate which is 2 mm in thickness, for example. It is positioned so that its cleaning edge is on the upstream side of its base in terms of the moving direction of the intermediary transfer belt 6. In order to prevent the cleaning blade 50*a* from being bent backward, and also, to ensure that the residual toner on the intermediary transfer belt 6 is uniformly removed across the intermediary transfer belt 6 while permitting a small amount of the residual toner to slip by, the angle of contact of the contact between the cleaning blade 50*a* and intermediary transfer belt 6 is desired to be in a range of 5°-25°. For example, it is set to 20°. As for the spring 50*b*, it is kept compressed between the base to which it is attached, and the cleaning blade 50*a*, so that a preset amount of contact pressure is maintained between the cleaning blade 50*a* and intermediary transfer belt 6. The contact pressure between the cleaning blade 50*a* and intermediary transfer belt 6 is desired to be in a range of 15 g/cm-g/cm; it is set to 18 g/cm, for example.

Also in the case of the image forming apparatus in this embodiment, which is structured as described above, the second transfer bias, that is, the transfer bias applied to the second transferring means, is controlled as in the case of the first embodiment. Thus, not only can the amount by which toner remains on the intermediary transfer belt 6 after the second transfer be reduced, but also, it is possible to reduce the amount of charge which the residual toner will have. The smaller the amount of charge of the residual toner on the intermediary transfer belt 6, the smaller the amount of attraction between the residual toner and intermediary transfer belt 6, and therefore, the more satisfactorily can the residual toner be removed by the cleaning apparatus 50.

[Second Example of Image Forming Apparatus in Accordance with Present Invention]

Next, the experiment carried out to confirm the effects of the second preferred embodiment of the present invention is described. In the experiment, an image forming apparatus having the contact cleaning apparatus 50 instead of the electrostatic cleaning devices 12 was tested in the same manner as the manner in which the first example of the image forming apparatus in accordance with the present invention was tested. That is, the comparative image forming apparatus is controlled based on only the amount of toner charge predicted based on the main assembly environment sensor 41 (FIG. 1). Whereas, the second example of the image forming apparatus in accordance with the present invention was controlled according to both the amount of toner charge predicted based on the environment (temperature and humidity) detected by the main assembly environment sensor 41 (FIG. 1) and the environment (temperature and humidity) detected by the developing device interior environment sensor 40 (internal) in the developing device (FIG. 1).

The experiment was carried out using an actual image forming apparatus in accordance with the present invention, and a comparative image forming apparatus. In the experiment, an image forming operation was repeatedly carried out by both image forming apparatuses while recording the glossiness of the intermediary transfer belt 6. Then, the two apparatuses were compared in terms of the glossiness of the intermediary transfer belt 6. The glossiness level of the intermediary transfer belt 6 was measured by a handy gloss-meter PG1 (product of Nippon Denshoku Co., Ltd.). As for the condition under which the experiment was conducted, the temperature and humidity were 23° C. and 50%, respectively. Further, the recording medium was a sheet of ordinary paper (80 gf/m$^2$), which was A3 in size. The test image was 10% in average image duty. The results of the experiment are shown in FIGS. 6 and 7.

Also in this experiment, the intermediary transfer belt 6 of the comparative image forming apparatus became progressively worse in terms of the level of the superficial adhesion of the external toner additives, becoming therefore progressively worse in glossiness, than the image forming apparatus in accordance with the present invention. The reason for this phenomenon seems to be as follows: As the average amount of toner charge becomes smaller relative to the amount of transfer current, electrical charge is transferred by an amount greater than the amount of toner charge, in the second transfer station, and therefore, the second transfer station reduces in transfer efficiency. To describe in more detail, the toner remaining on the intermediary transfer belt 6 after the second transfer has reversed in polarity, being therefore positive. This residual toner, or the toner which was reversed in polarity and failed to be transferred, is large in the amount of charge, being therefore greater in the amount by which it is electrostatically attracted to the intermediary transfer belt 6. Therefore, it reduces the cleaning performance of the cleaning edge of the cleaning blade 50*a*. Further, even if the residual toner itself can be removed by the cleaning blade 50*a*, the external toner additives, which are more likely to slip by the cleaning blade 50*a* than the toner itself, slip by the cleaning blade 50*a*, and reduce the intermediary transfer belt 6 in glossiness. Thus, in order to keep the intermediary transfer belt 6 above a preset level in terms of glossiness, the second transfer station must be kept optimum in transfer efficiency.

On the other hand, in the case of the second example of an actual image forming apparatus in accordance with the present invention, the glossiness reduction of the intermediary transfer belt 6 is significantly more gradual than that of the comparative apparatus, as shown by the solid line in FIG. 6. In other words, in the case of the second example of the actual image forming apparatus in accordance with the present invention, the amount of toner charge was more accurately predicted than in the case of the comparative apparatus, and therefore, the predicted amount of toner charge, which was fed back to the CPU 42, was much closer to the actual amount of toner charge. Therefore, the second example of the actual image forming apparatus in accordance with the present invention was significantly smaller in the amount by which toner remained on the intermediary transfer belt 6 after the second transfer. Therefore, its image bearing member, that is, the intermediary transfer belt 6, remained relatively stable in reflectivity, thus enabling the image formation control patch to be accurately detected. Therefore, it was possible for the second example of image forming apparatus in accordance with the present invention to be highly reliably controlled.

Embodiment 3

Figure 9:
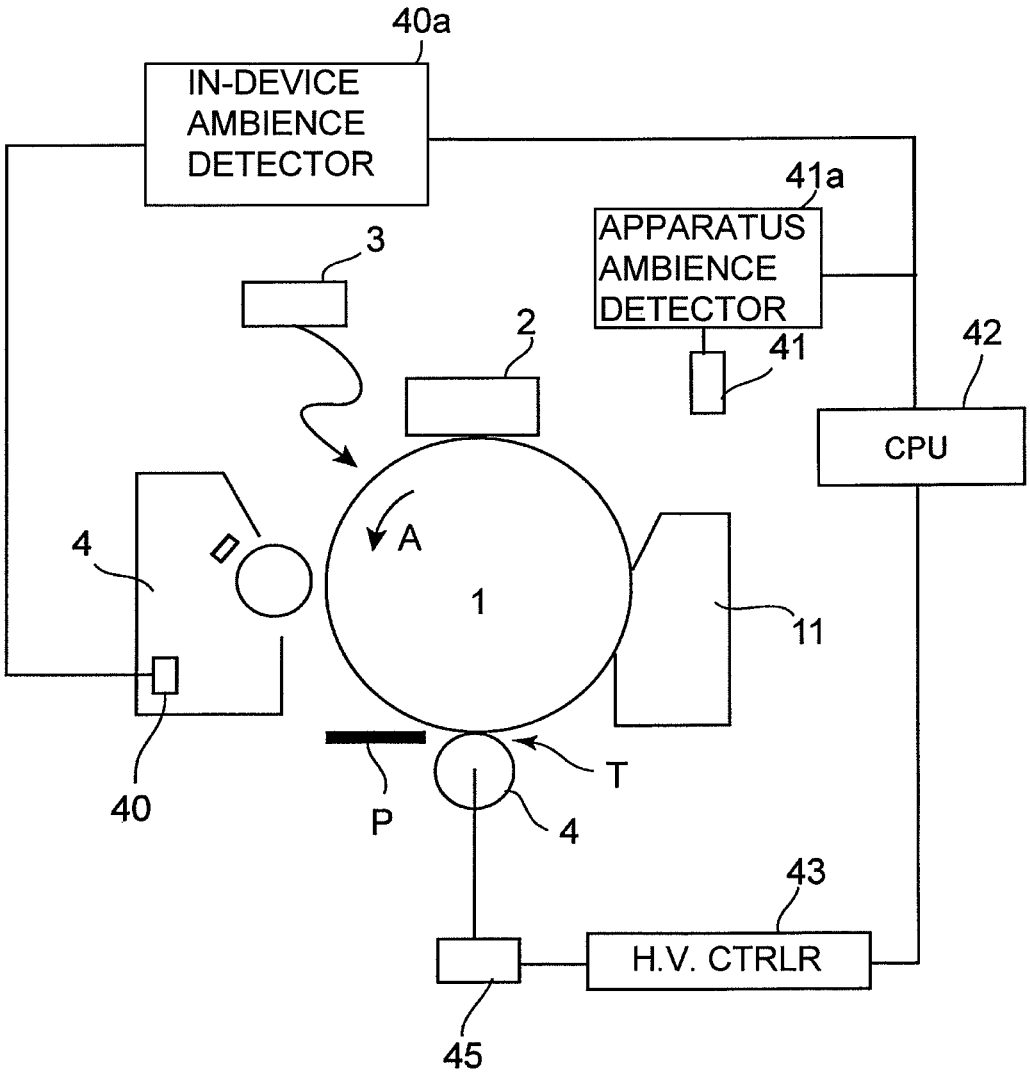
FIG. 9 is a schematic illustration of an image forming apparatus according to a third embodiment of the present invention.

Next, referring to FIG. 9, the third preferred embodiment is described. This embodiment is different from the first and second embodiments in that this embodiment is an example of the application of the present invention to an image forming apparatus of the so-called direct transfer type, whereas the first and second embodiments are examples of the application of the present invention to an image forming apparatus of the so-called intermediary transfer type. In terms of the transfer bias control and the structure and positioning of each sensor, this embodiment is the same as the first and second embodiments. To begin with, the general structure of the image forming apparatus in this embodiment is described.

The image bearing member of the image forming apparatus in this embodiment is a cylindrical electrophotographic photosensitive member 1 (which hereafter is referred to as "photosensitive drum"), and is rotated in the direction indicated by an arrow mark A. The surface layer of the photosensitive drum 1 is formed of OPC (organic photosensitive semiconductor). Designated by a referential code 2 is a charging device for uniformly charging the peripheral surface of the photosensitive drum 1. As a preset bias is applied to the charging device 2, the charging device 2 charges the peripheral surface of the photosensitive drum 1 to a preset potential level. The charged peripheral surface of the photosensitive drum 1 is exposed to (scanned by) a beam of exposure light (laser light, or the like) by an exposing device 3, whereby an electrostatic latent image, which reflects the information of an image to be formed, is formed. The information of the image to be formed is inputted into the image forming apparatus from an external device, such as an unshown image scanner, computer, or the like.

A developing device 4 develops the electrostatic latent image, with the toner charged by its development roller. That is, it forms a visible image, that is, an image formed of the toner, on the peripheral surface of the photosensitive drum 1. The toner image on the photosensitive drum 1 is transferred onto a sheet P of recording medium, in the transfer station T, which is the interface between the photosensitive drum 1 and a transfer roller 5. To the transfer roller 5, high voltage (transfer voltage), the magnitude of which is being kept stable at a preset level by a CPU 42, is applied from an electric power source 43 through a transfer voltage control circuit 43, whereby the toner images are transferred onto the sheet P of recording medium from the photosensitive drum 1. Incidentally, the photosensitive drum 1 is grounded. In this embodiment, the transfer roller 5 and electric power source 45 make up the transferring means.

The transfer residual toner, that is, the toner remaining on the peripheral surface of the photosensitive drum 1 after the first transfer, is removed by a photosensitive drum cleaning device 11, which is a contact cleaning apparatus that removes the transfer residual toner on the peripheral surface of the photosensitive drum 1 by placing its cleaning blade or the like in contact with the peripheral surface of the photosensitive drum 1. After the removal of the transfer residual toner from the photosensitive drum 1, the photosensitive drum 1 is again uniformly charged by the charging device 2, and is used for the next image formation. That is, the peripheral surface of the photosensitive drum 1 is repeatedly used for image formation.

Meanwhile the sheets P of recording medium in a sheet feeder cassette (unshown) are fed one by one into the main assembly of the image forming apparatus while being separated from the rest. Then, each sheet P is conveyed further into the apparatus main assembly with such a control timing that it arrives at the transfer station T at the same time as the toner image on the photosensitive drum 1 arrives at the transfer station T.

In this embodiment, the image forming station is structured as described above. The image formed on the sheet P of recording medium by the image forming station described above is fixed to the sheet P by an unshown fixing device. More specifically, after the transfer of the toner image onto the sheet P, the sheet P is introduced into the fixing apparatus, in which heat and pressure is applied to the toner image on the sheet P, whereby the toner image is fixed to the surface of the sheet P.

Next, the CPU 42, which is a controlling means for controlling the transfer bias to be applied to the transferring means is in connection to a main assembly environment detection circuit 41*a*, a developing device interior environment detection circuit 40*a*, an image formation control circuit 44, and a transfer voltage control circuit 43, will be described. The main assembly environment detection circuit 41*a* is positioned so that it is in the main assembly of the image forming apparatus, and outside the developing device 4, whereas the developing device interior environment detection circuit 40*a* is within the developing device 40. The CPU 42 is controlled by a control program. It obtains signals which reflect the internal temperature, humidity, etc., of the image forming apparatus and developing device from the main assembly environment detection circuits 41*a* and developing device interior environment detection circuit 40*a*, respectively, and outputs the signals for forming the monochromatic toner images Y, M, C, and Bk colors, to the image formation control circuit 44. Further, at the same time, the CPU 42 properly controls the transfer biases by sending transfer bias control signals to the transfer bias control circuit 43.

In this embodiment, the transfer biases are controlled as follows: First, the CPU 42 determines (predicts) the amount by which transfer current is to be flowed through the second transferring means, based on the absolute amount (result of detection) of the internal moisture in the apparatus calculated by the main assembly environment detection circuit 41*a*, from the values detected by the main assembly environment sensor 41, which is the first environment detecting means. This decision is made with reference to the tables, etc., which show the relationship among the absolute amount of the moisture, impedance, and amount of toner charge, which are stored in the CPU 42.

Further, in this embodiment, the image forming apparatus is structured so that the transfer bias setting is properly adjusted by positioning the developing device interior environment detecting means, that is, the second environment detecting means, in the developing device, that is, where the toner is actually present, so that the relative humidity of the toner, based on which the amount of toner charge is predicted, is accurately detected. More concretely, the first amount of toner charge, which corresponds to the results of environment detection by the main assembly environment sensor 41, is compared with the second amount of toner charge, which corresponds to the results of environment detection by the developing device interior environment sensor 40. That is, the CPU 42 compares the amounts of toner charge obtained with reference to the tables which it contain and correspond to the results of environment detection by the sensors 41 and 40. Then, if the second amount of toner charge is no more than the first amount of toner charge, it adjust the transfer bias so that the transfer current is reduced in proportion to the difference between the first and second amounts of toner charge. That is, the CPU 42 controls the transfer bias so that the transfer current is flowed through the transferring means by the adjusted amount.

According to this embodiment, the amount by which toner remains on the peripheral surface of the photosensitive drum 1 after the first transfer can be reduced by preventing the value of the transfer bias falling beyond the transfer bias range in which the amount of toner charge is proper for transfer. In other words, this embodiment can improve an image forming apparatus in transfer efficiency. Further, this embodiment can prevent the residual toner from increasing in the amount of charge. Therefore, it can reduce the amount of the electrostatic attraction between the residual toner and the photosensitive drum 1. Therefore, it can make it possible to satisfactorily remove and recover the transfer residual toner by the photosensitive drum cleaning device 11. The structure and function of the components other than those described above are the same as those in the first and second embodiments.

Incidentally, in each of the above-described preferred embodiments, the image forming apparatus was structured so that its CPU 42 contains the tables which show the relationship between the first amount of toner charge, and the results of environment detection by the main assembly environment sensor 41, and the relationship between the second amount of toner charge, and the results of environment detection by the developing device interior environment sensor 40. However, the present invention is also compatible with an image forming apparatus which adjusts the amount by which transfer current is to be flowed, by directly comparing the results of environment detection by the main assembly environment detection sensor 41 and those of the developing device interior environment sensor 40. For example, an image forming apparatus may be structured as follows: The amount by which the transfer current is to be adjusted according to the amount of difference between the amount of humidity detected by the main assembly environment sensor 41 and the amount of humidity detected by the developing device interior environment sensor 40. Then, the amount by which the transfer current is to be flowed is directly adjusted according to this relationship between the preset adjustment value and the amount of difference between the amount of humidity detected by the sensor 41 and the amount of humidity detected by the sensor 40. More concretely, if the amount of humidity detected by the developing device interior environment sensor 40 is no less than the amount of humidity detected by the main assembly environment sensor 41, the transfer bias is adjusted so that the amount by which transfer current is to be followed is reduced by the amount proportional to the amount of difference between the two detected amounts of humidity.

Further, in each of the preferred embodiments of the present invention described above, the image forming apparatus was either an image forming apparatus of the tandem type, and also, of the intermediary transfer type, or a monochromatic image forming apparatus of the direct transfer type. However, the present invention is also applicable to various image forming apparatuses other than those described above. For example, the present invention is also applicable to a full-color image forming apparatus of the direction transfer type.

As described above, according to the present invention, the amount by which transfer current is to be flowed can be adjusted according to the environment in the developing device. Therefore, it can keep transfer efficiency at an optimal level, being therefore capable of minimizing the amount by which toner is likely to remain on image bearing members after transfer. Therefore, it can ensure that the residual toner is satisfactorily removed by the image bearing member cleaning device. Therefore, it can reduce the problem that an image forming apparatus outputs unsatisfactory images.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 113292/2010 filed May 17, 2010 which is hereby incorporated by reference.

What is claimed is:

1. An image forming apparatus comprising:

an image bearing member;

a developing device for developing an electrostatic latent image formed on said image bearing member;

transferring means for transferring the toner image formed on said image bearing member onto a transfer material;

first ambience detecting means for detecting a humidity inside said image forming apparatus and outside said developing device;

second ambience detecting means for detecting a humidity inside said developing device; and setting means for setting a transferring current of said transferring means on the basis of results of detection of said first ambience detecting means and said second ambience detecting means.

2. An apparatus according to claim 1, further comprising bias condition setting means for setting a bias condition applied to said transferring means on the basis of the detection result of one of said ambience detecting means, and adjusting means for adjusting the bias condition setting by said bias condition setting means on the basis of the detection result of the other of said ambience detecting means.

3. An apparatus according to claim 1, wherein the bias condition provided by said correcting means is such that a transferring current value decreases with an increase of a relative humidity detected by second ambience detecting means.

4. An apparatus according to claim 1, wherein said control means compares a first predicted toner charge amount corresponding to the result of the detection of said first ambience detecting means and a second predicted toner charge amount corresponding to the result of the detection of said second ambience detecting means, and when the second predicted toner charge amount is not more than the first predicted toner charge amount, said control means decreases the transferring current in accordance with a difference therebetween.

* * * * *